United States Patent [19]

Asari et al.

[11] Patent Number: 4,968,009

[45] Date of Patent: Nov. 6, 1990

[54] COOLING DEVICE FOR A HIGH TEMPERATURE, HIGH PRESSURE VESSEL

[75] Inventors: Akira Asari, Nishinomiya; Takahiko Ishii, Kobe; Yutaka Narukawa, Nishinomiya, all of Japan

[73] Assignee: Kabushiki Kaisha Kobe Seiko Sho, Kobe, Japan

[21] Appl. No.: 397,881

[22] Filed: Aug. 23, 1989

[30] Foreign Application Priority Data

Aug. 27, 1988 [JP] Japan ..... 63-214364
Jun. 1, 1989 [JP] Japan ..... 1-140290

[51] Int. Cl.[5] ..... C21D 1/06

[52] U.S. Cl. ..... 266/252; 266/249; 266/259; 432/251

[58] Field of Search ..... 266/249, 252, 259; 425/405.2; 432/251

[56] References Cited

U.S. PATENT DOCUMENTS

| | | | |
|---|---|---|---|
| 3,419,935 | 1/1969 | Pfeiler et al. | 425/78 |
| 3,752,456 | 8/1973 | Larker | 266/252 |
| 3,790,340 | 2/1974 | Isaksson et al. | 266/252 |
| 4,401,297 | 8/1983 | Doi et al. | 266/252 |
| 4,830,342 | 5/1989 | Boneff | 266/252 |

FOREIGN PATENT DOCUMENTS

| | | |
|---|---|---|
| 0170728 | 2/1986 | European Pat. Off. . |
| 0430566 | 6/1926 | Fed. Rep. of Germany . |
| 0444266 | 7/1926 | Fed. Rep. of Germany . |
| 2006410 | 5/1979 | United Kingdom . |
| 2176883 | 6/1987 | United Kingdom . |
| 2198826 | 6/1988 | United Kingdom . |

*Primary Examiner*—S. Kastler
*Attorney, Agent, or Firm*—Oblon, Spivak, McClelland, Maier & Neustadt

[57] ABSTRACT

A cooling device for a high pressure vessel which is simple in construction and high in safety and has a high cooling faculty without the necessity of changing a design of the high pressure vessel. The cooling device has a cylindrical cooling medium jacket having a cooling medium passage formed therein. The cooling medium jacket is removably disposed in a high pressure chamber of the high pressure vessel between the high pressure vessel and an insulation mantle surrounding a heater in the high pressure chamber such that a gap may be left between the high pressure vessel and the cooling medium jacket. The cooling medium jacket has a passage hole formed therein for establishing communication between the gap and the high pressure chamber to allow pressure medium to be introduced into the gap. The cooling device further includes a pressure medium supply means provided in the gap for introducing therethrough pressure medium different from the pressure medium for the HIP process to support THE cooling medium jacket with a hydraulic pressure of the different pressure medium.

16 Claims, 12 Drawing Sheets

COOLING DEVICE FOR A HIGH TEMPERATURE, HIGH PRESSURE VESSEL

BACKGROUND OF THE INVENTION

1. Field of the Invention

This invention relates to a cooling device for a high temperature, high pressure vessel and is applied to a hot isostatic pressurizing equipment (HIP equipment).

2. Description of the Prior Art

Various HIP equipments which make use of involved effects of a high isostatic pressure and a high temperature in a high pressure vessel for pressurizing sintering of powder material of various metals, ceramics and so forth, removal of internal defects of cast articles and sintered articles, diffused junction and so forth are employed in various industrial fields.

Since such a HIP equipment, particularly a high pressure vessel therein, is acted upon by a high internal pressure equal to or higher than 1,000 kgf/cm$^2$ and also undergoes a high temperature, an inner wall of the vessel at which a highest stress takes place as the pressure rises begins its plastic deformation, and if the region of the plastic deformation increases until the entire vessel is plastically deformed, there is the possibility that the vessel may be broken.

Further, if the temperature in use rises, a creep phenomenon may take place under a fixed pressure, and if the repetition frequency of pressurization increases, there is the possibility that a fatigue failure may take place in the vessel.

Such circumstances as described above must be coped with from a point of view of assurance of safety. To this end, a heat insulating structure, cooling of the vessel and so forth are required for a HIP equipment. Exemplary devices for cooling a vessel are disclosed. for example, in Japanese Patent Publication No. 56-8717. The prior art devices have such a construction as shown in FIGS. 15 and 16.

Referring first to FIG. 15, a HIP equipment includes a high pressure cylinder 110 as a main body. The high pressure cylinder 110 is composed of an inner tube 130 and a sheath 131 formed from a band which surrounds an outer periphery of the inner tube 130 and on which a stress is imposed in advance. A steel plate tube 136 is interposed between the inner tube 130 and the sheath 131, and a large number of rods 133 are placed between the inner tube 130 and the steel plate tube 136 and extend in an axial direction to form an annular layer. Cooling medium is flowed along paths 139 between the steel plate tube 136 and the rods 133 to cool the high pressure cylinder 110 from the outside.

Referring now to FIG. 16, a HIP equipment shown is a modification to the HIP equipment shown in FIG. 15. In the modified HIP equipment, rectangular rods 150 are placed between an inner sheath 131*a* and an outer sheath 131*b* each formed from a band such that a cooling water path 151 may be formed between each adjacent ones of the rectangular rods 150 so as to cool a high pressure cylinder 110 similarly from the outside.

Meanwhile, improvement in productivity is also an important subject of a HIP equipment.

In particular, a HIP equipment has a fault that processing for one cycle requires a long period of time.

Thus, improved HIP equipments have been proposed wherein convection flows of gas are made use of in a cooling step after completion of a HIP processing step in order to reduce the cooling time. An exemplary one of such improved HIP equipments is disclosed, for example, in Japanese Utility Model Publication No. 62-24238.

However, the prior art HIP equipments shown in FIGS. 15 and 16 and described hereinabove are disadvantageous in cooling effect and also in that the high pressure cylinder is complicated in structure because the cooling device is provided on the outer periphery of the high pressure cylinder to cool the inside of the high pressure cylinder. Besides, in order for the cooling device to have a high and efficient cooling function, the entire HIP equipment including the high pressure cylinder must be increased in diameter and also in overall size.

Further, use of such large number of axially extending rods 133 requires a very high degree of accuracy in working accuracy of outer faces of the rods 133 and also in assembling accuracy and so forth of the rods 133 and also requires a high production cost in order to allow the rods 133 to be used as components of a high pressure vessel which can stand a high pressure, for example, higher than 500 atmospheres. Besides, after the rods 133 are assembled once, it is difficult to confirm a surface condition of the inner tube 130, sheath 131, inner wall 132, tube outer face 135 and so forth, and maintenance of the cooling device itself is difficult.

Further, since the prior art HIP equipments involve cooling only from the outside of the vessel, even if the technique of the improved HIP equipments described above is combined with the prior art HIP equipments, involved actions of convection flows of gas and cooling of the vessel cannot be exhibited satisfactorily.

SUMMARY OF THE INVENTION

It is an object of the present invention to provide a cooling device for a high temperature, high pressure vessel which is simple in construction and high in safety and has a high cooling faculty without the necessity of changing a design of the high pressure vessel itself.

It is another object of the present invention to provide a cooling device for a high temperature, high pressure vessel which can exhibit involved effects of cooling of the inside of the vessel and convention flows of gas effectively to reduce the time required for cooling.

In order to attain the above objects, according to one aspect of the present invention, there is provided a device for cooling a high temperature, high pressure vessel of a hot isostatic pressurizing equipment which includes a high pressure vessel having at the axial opposite ends thereof a pair of openings which are each closed by removable closure members to define a high pressure chamber in the inside of the high pressure vessel, a heater disposed in the high pressure chamber, an insulation mantle surrounding the heater in the high pressure chamber, and a pressure medium supply means for supplying pressure medium into the high pressure chamber, the device comprising a cylindrical cooling medium jacket having a passage for cooling medium formed therein, the cooling medium jacket being removably disposed in an axial direction of the high pressure vessel in the high pressure chamber between an inner face of the high pressure vessel and an outer face of the insulation mantle such that a gap may be left between the inner face of the high pressure vessel and an outer face of the cooling medium jacket, the cooling medium jacket having a passage hole for pressure medium formed therein for establishing communication between the gap and the high pressure chamber to allow pressure medium to be introduced into the gap.

With the cooling device, since the cooling medium jacket which can exhibit a high cooling effect without the necessity of changing the design of the high pressure vessel compared with a conventional cooling means which cools a high pressure vessel from the outside is mounted in the inside of the high pressure vessel with the gap left therebetween, cooling of the inside of the high pressure vessel can be made without the possibility of heat loss. Accordingly the cooling device has a high heat exchanging capability compared with a conventional cooling device of the externally cooling type and can attain a very efficient cooling operation.

Further, since the cooling medium jacket can be readily removed from the high pressure vessel, confirmation of a condition of the inner face of the high pressure vessel can be made readily. Thus, the cooling device can attain sufficient safety as a cooling device for a high temperature, high pressure vessel for use with a hot isostatic pressuring equipment.

Besides, at a cooling step after a hot isostatic pressuring process, a heat exchanging action by convection flows of gas is very high because the cooling medium jacket is disposed in the inside of the high pressure vessel. Accordingly, significant improvement in production efficiency involved in reduction in time required for the cooling step can also be attained.

According to another aspect of the present invention, there is provided a device for cooling a high temperature, high pressure vessel of a hot isostatic pressurizing equipment which includes a high pressure vessel having at the axial opposite ends thereof a pair of openings which are each closed by removable closure members to define a high pressure chamber in the inside of the high pressure vessel, a heater disposed in the high pressure chamber, an insulation mantle surrounding the heater in the high pressure chamber, and a pressure medium supply means for supplying pressure medium into the high pressure chamber, the device comprising a cylindrical cooling medium jacket having at least one passage for cooling medium formed therein, the cooling medium jacket being removably disposed in an axial direction of the high pressure vessel in the high pressure chamber between an inner face of the high pressure vessel and an outer face of the insulation mantle such that a gap may be left between the inner face of the high pressure vessel and an outer face of the cooling medium jacket, and another pressure medium supply means provided in the gap for introducing therethrough pressure medium different from the pressure medium for the hot isostatic pressurizing process to support the cooling medium jacket with a hydraulic pressure of the different pressure medium.

With the cooling device, since the area of the inner surface of the cooling medium jacket is smaller than the area of the outer surface of the cooling medium jacket, a comparatively small force on the inner surface of the cooling medium jacket can provide a pressure balance at the cooling medium jacket with the pressure of the pressure medium in the inside of the high pressure vessel. Thus, as the pressure medium for the hot isostatic pressurizing process is communicated in the gap or the pressure medium different from the pressure medium for the hot isostatic pressurizing process is supplied into the gap, the cooling medium jacket can be held by a hydraulic pressure of the pressure medium. Consequently, the balance between the inside and the outside of the cooling medium jacket can be accomplished readily with a simple construction.

The above and other objects, features and advantages of the present invention will become apparent from the following description and the appended claims, taken in conjunction with the accompanying drawings in which like parts or elements are denoted by like reference characters all through the several figures.

DETAILED DESCRIPTION OF THE PREFERRED EMBODIMENTS

Figure 1:
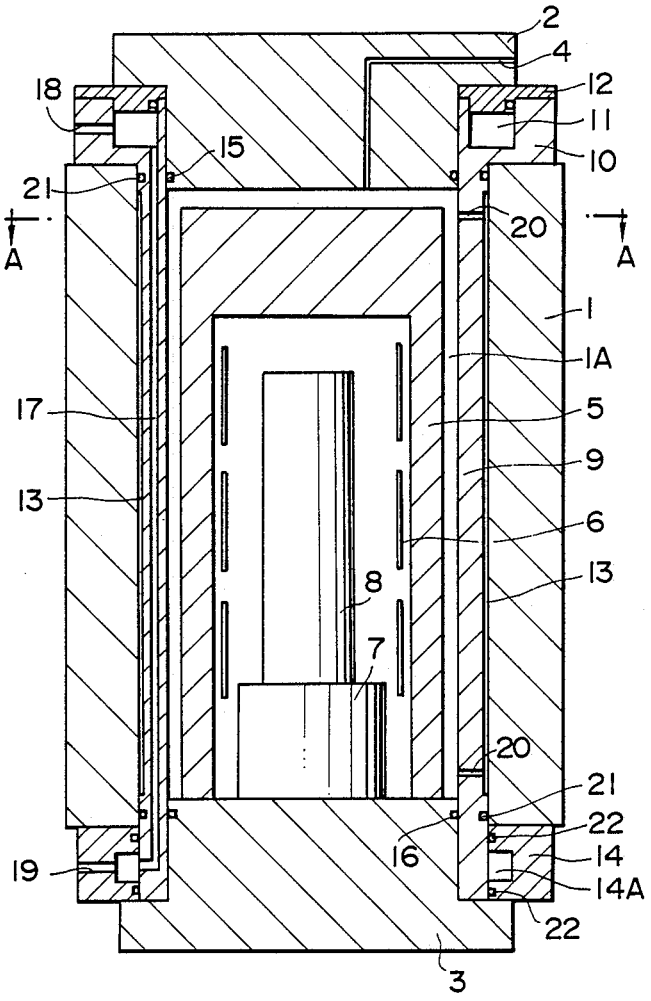
FIG. 1 is a vertical sectional front elevational view of a cooling device for a high pressure vessel showing a first preferred embodiment of the present invention.
Figure 2:
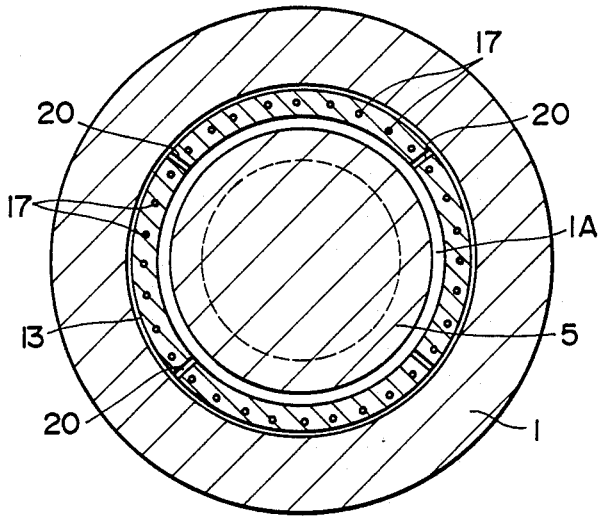
FIG. 2 is a sectional view taken along line A—A of FIG. 1.

Referring first to FIGS. 1 and 2, there is shown a cooling device for a high pressure vessel according to the present invention. A high pressure vessel generally denoted at 1 is in the form of a cylindrical body having a smooth inner face. The cylindrical high pressure vessel 1 in the embodiment shown is open at the opposite ends thereof, and the two openings thereof are closed with removable closure members, that is, a top closure 2 and a bottom closure 3 to define a high pressure chamber 1A in the inside of the high pressure vessel 1.

The top closure 2 has a pressurizing pressure inlet 4 formed therein for supplying therethrough pressure medium gas selected from various gases including inert gas such as argon into the high pressure chamber 1A. A pressure medium supplying means including a gas compressor, a pressure regulator and so forth is connected to the inlet 4, and the inlet 4 of the top closure 2 thus forms part of the pressure medium supplying means.

An insulation mantle 5 having an inverted U- or cup-shaped cross section is disposed in the high pressure chamber 1A of the high pressure vessel 1 and constitutes a furnace body together with a heater 6 contained in the insulation mantle 5. A work piece 8 is placed on a mounting block 7 on the bottom closure 3 and is isostatically pressurized in the high pressure chamber 1A. It is to be noted that the furnace body in the first embodiment may be in the form of a graphite furnace which is composed of a graphite heater and an insulation mantle made of several graphite materials or else a molybdenum furnace.

The high pressure vessel 1 further includes a cylindrical cooling medium jacket 9 constituted from the same material as the high pressure vessel 1, for example, from a low alloy steel. The cooling medium jacket 9 is removably mounted in an axial direction of the high pressure vessel 1 in the high pressure vessel 1 in a coaxial relationship with the high pressure vessel 1 and the furnace body.

In the first embodiment, a flange 10 is formed at the top end portion of the cooling medium jacket 9 and defines an annular upper cooling medium tank 11 therein together with a cover 12 of the upper cooling medium tank 11. An annular gap 13 is formed over the substantially entire axial length of the high pressure vessel 1 between an inner face of the high pressure vessel 1 and an outer peripheral face of the cooling medium jacket 9 which is interposed between the inner face of the high pressure vessel 1 and an opposing outer peripheral face of a body portion of the insulation mantle 5.

The bottom end of the cooling medium jacket 9 is fitted in a ring 14 for cooling medium circulation mounted at a lower end face of the vessel 1. The ring 14 has an annular lower cooling medium tank 14A formed therein. The top closure 2 is removably fitted in an upper opening of the cooling medium jacket 9 with an upper seal ring 15 interposed therebetween while the bottom closure 3 is removably fitted in a lower opening of the cooling medium jacket 9 with another lower seal ring 16 interposed therebetween. The flange 10 of the cooling medium jacket 9 is held between the top closure 2 and a top end face of the vessel 1 while the ring 14 is pressed against the vessel 1 by the bottom closure 3.

A number of cooling medium passages 17 are formed in a circumferentially spaced relationship in the cooling medium jacket 9 as shown in FIG. 2 and extend in the axial direction of the vessel 1 such that they may establish communication between the upper and lower cooling medium tanks 11 and 14A. Thus, as cooling medium such as, for example, water is supplied to flow from a cooling medium inlet passage 18 formed in the upper cooling medium tank 11 to a cooling medium outlet passage 19 formed in the lower cooling medium 14A, the inner face of the high pressure vessel 1 is cooled by the water passing through the cooling medium passages A plurality of, four in the embodiment shown, passage holes 20 for pressure gas are formed radially at each of upper and lower end portions of the cooling medium jacket 9 as shown in FIG. 2 such that they may establish communication between the high pressure chamber 1A and the gap 13 to introduce therethrough pressure medium (gas) from within the high pressure chamber 1A into the gap 13 to attain a pressure balance between the inside and the outside of the cooling medium jacket 9 to prevent possible deformation of the cooling medium jacket 9.

It is to be noted that a press axial tension acting in the axial direction of the vessel 11 during the HIP process is carried by a press frame, not shown, which is removably mounted on the top closure 2 and the bottom closure 3.

The high pressure vessel 1 further includes, as shown in FIG. 1, another lower seal ring 21 provided at each of upper and lower portions of an outer periphery of the cooling medium jacket 9 for sealing an interface between the inner face of the vessel 1 and the outer periphery of the cooling medium jacket 9. A seal 22 for cooling medium is provided at each of upper and lower portions of an inner peripheral face of the ring 14 for sealing an interface between the inner peripheral face of the ring 14 and the outer periphery of the cooling medium jacket 9 to prevent leakage of cooling medium from the lower cooling medium tank 14A.

Figure 3:
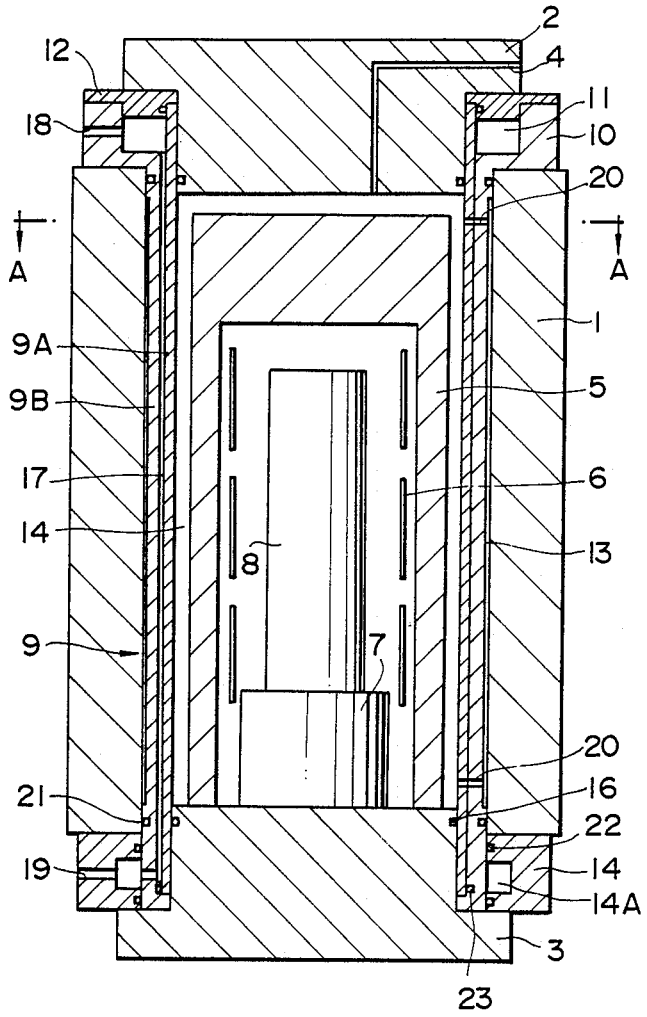
FIG. 3 is a vertical sectional front elevational view similar to FIG. 1 but showing a second preferred embodiment of the present invention.
Figure 4:
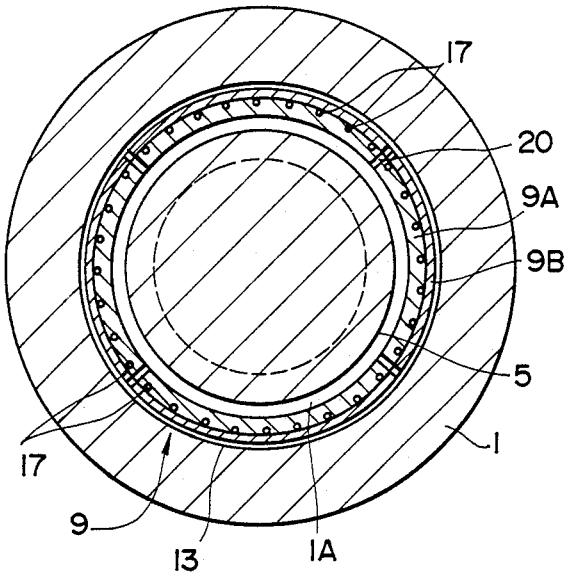
FIG. 4 is a sectional view taken along line A—A of FIG. 3.
Figure 5:
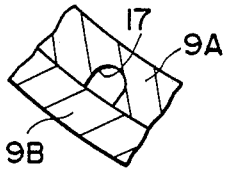
FIG. 5 (1), 5(2) and 5(3) are enlarged horizontal sectional views at different portions of the cooling device shown FIG. 4.
Figure 5:
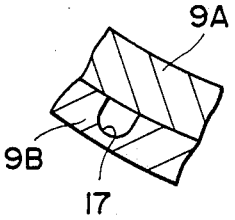
Figure 5:
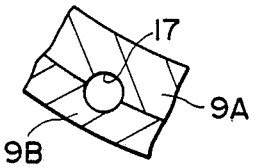

FIGS. 3, 4 and 5 show a second preferred embodiment of the present invention. The cooling device of the second embodiment is generally similar in construction to the cooling device of the first embodiment and only different in that the cooling medium jacket 9 is composed of an inner tube 9A and an outer tube 9B with cooling medium passages 17 defined between opposing faces of the two tubes 9A and 9B of the cooling medium jacket 9, and a seal ring 23 for preventing leakage of cooling medium is provided at a fitting portion of a lower end portion of the inner tube 9A of the cooling medium jacket 9. Since the remaining construction is similar to that of the first embodiment, further description is omitted herein.

It is to be noted that the cooling medium passages 17 may be formed in several manners. In particular, the cooling medium passages 17 may be formed on an outer periphery of the inner tube 9A of the cooling medium jacket 9 as shown FIG. 5(1); or they may be formed on an inner periphery of the outer tube 9B as shown in FIG. 5(2); or otherwise they may be formed on both of the inner and outer tubes 9A and 9B of the cooling medium jacket 9 as shown in FIG. 5(3). Further, the cross sectional shape of the cooling medium passages 17 is not limited to such specific shapes as seen in FIGS. 5(1), 5(2) and 5(3) and may be some other shape such as a rectangular shape.

Figure 6:
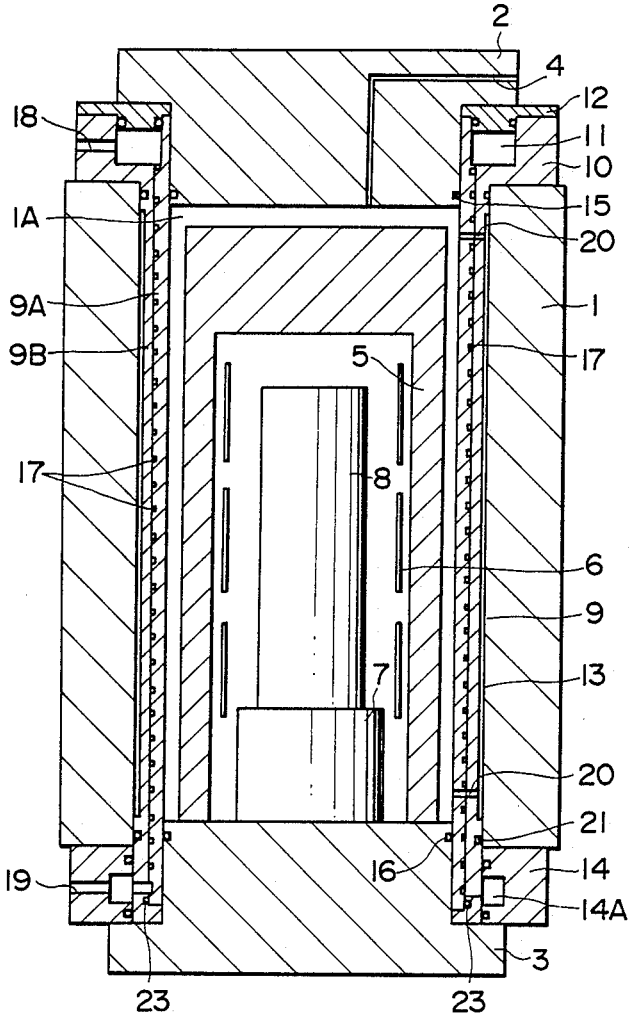
FIG. 6 is a vertical sectional front elevational view similar to FIG. 1 but showing a third preferred embodiment of the present invention.
Figure 7:
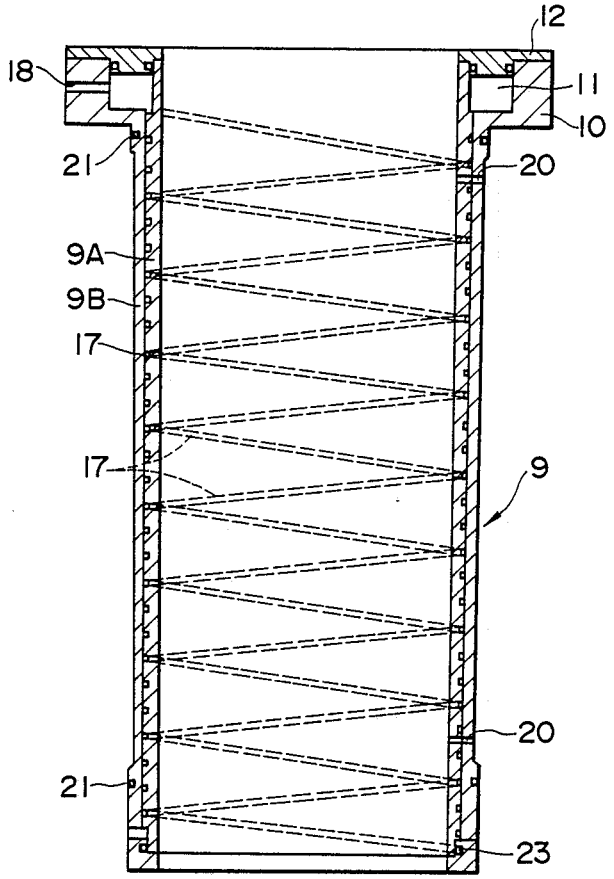
FIG. 7 is a vertical sectional view of a cooling medium jacket of the cooling device shown in FIG. 6.

FIGS. 6 and 7 show a third preferred embodiment of the present invention. The cooling device of the third embodiment is a modification of the cooling device of the second embodiment described above in that the cooling medium passages 17 of the second embodiment defined by the inner and outer tubes 9A and 9B which are formed separately and assembled into the cooling medium jacket 9 are formed to extend in a spiral configuration from the top end side to the bottom end side along the body portion of the cooling medium jacket 9 so as to attain a cooling effect over the entire inner periphery of the vessel 1.

The cooling medium passages in the third embodiment may be formed on opposing faces of the inner and outer tubes 9A and 9B of the cooling medium jacket 9 in a similar manner as shown in any one of FIGS. 5(1), 5(2) and 5(3), and they may be formed as a plural number of passages or otherwise only by one. Since the other construction is similar to that of the second embodiment, overlapping description is omitted herein.

Figure 8:
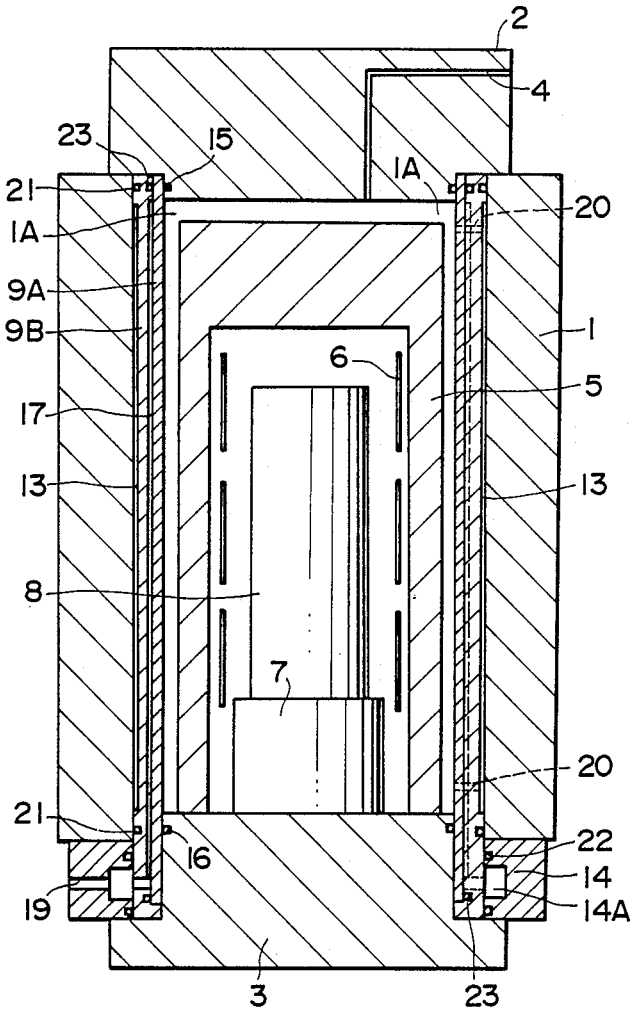
FIG. 8 is a vertical sectional front elevational view similar to FIG. 1 but showing a fourth preferred embodiment of the present invention.
Figure 9:
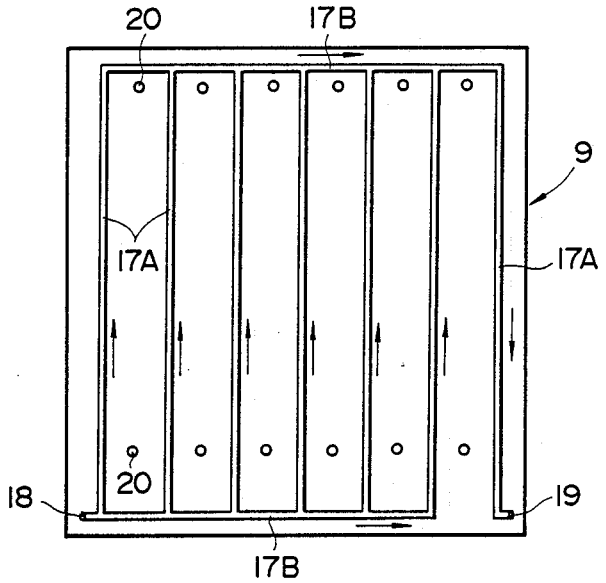
FIG. 9 is a developed view of part of a cooling medium jacket of the cooling device shown in FIG. 6.

FIGS. 8 and 9 show a fourth preferred embodiment of the present invention. The cooling device of the present embodiment is generally similar in construction to those of the preceding embodiments and is only different in that a cooling medium jacket 9 is removably mounted on a high pressure vessel 1 together with a bottom closure 3 on which a ring 14 for cooling medium circulation having a lower cooling medium tank 14A thereon, and the lower cooling medium tank 14A is provided with a cooling medium inlet passage 18 and a cooling medium outlet passage 19 which are interconnected by way of axial paths 17A for cooling medium and circular paths 17B for cooling medium as shown in FIG. 9.

It is to be noted that, in the fourth embodiment, a furnace body including an insulation mantle 5 is supported on a bottom closure 3.

Figure 10:
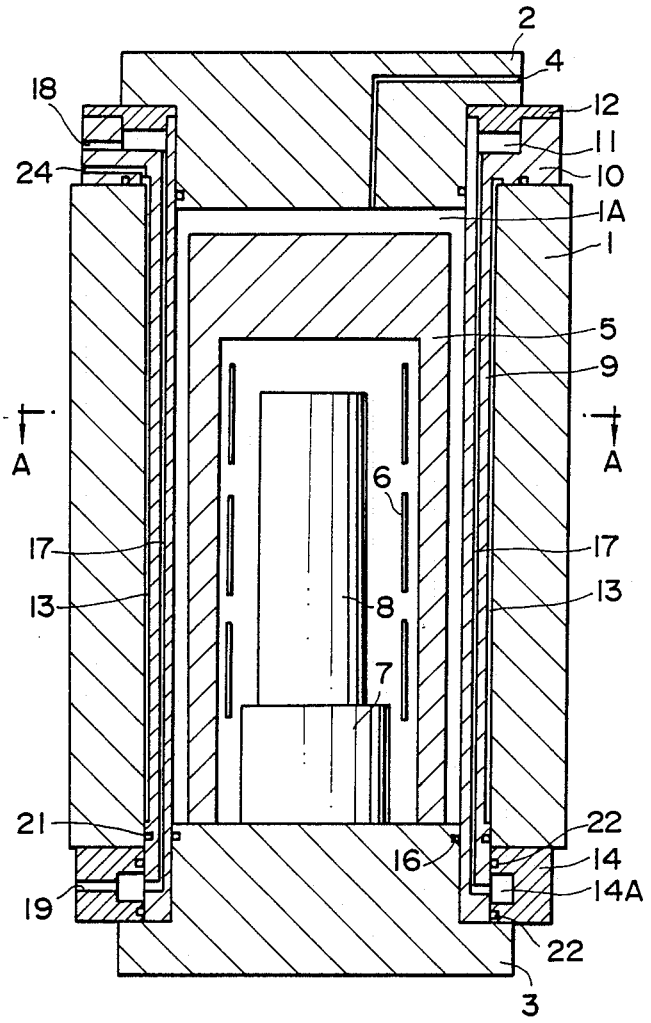
FIG. 10 is a vertical sectional front elevational view similar to FIG. 1 but showing a fifth preferred embodiment of the present invention.
Figure 11:
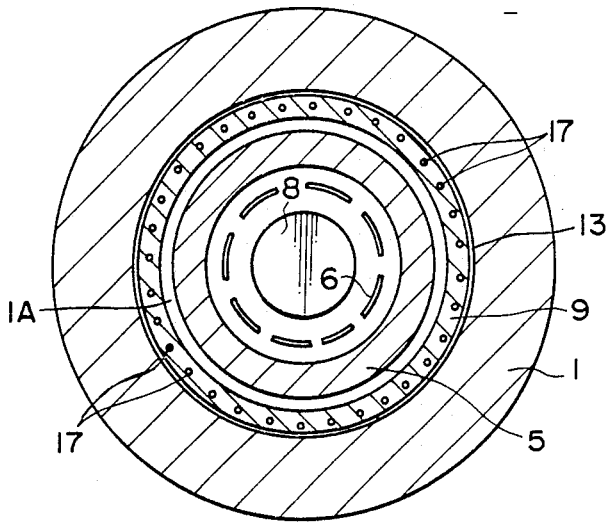
FIG. 11 is a sectional view taken along line A—A of FIG. 10.

FIGS. 10 and 11 show a fifth preferred embodiment of the present invention. The cooling device of the present embodiment is a modification of the cooling device of the first embodiment shown in FIGS. 1 and 2 in that the flange 10 of the cooling medium jacket 9 has formed therein an inlet 24 of liquid pressure medium for introducing therethrough water, oil or some other fluid pressure medium different from the gas pressure medium for the HIP process into the gap 13 between the inner face of the high pressure vessel 1 and the outer face of the cooling medium jacket 9. With the cooling device of the present embodiment, the cooling medium jacket 9 is supported or carried against an internal pressure acting upon the cooling medium jacket 9 during the HIP process by the pressure of the fluid introduced into the gap 13.

With the cooling device of the fifth embodiment, the stress of the high pressure vessel 1 can be controlled as the cooling medium jacket 9 is supported hydraulically.

Figure 12:
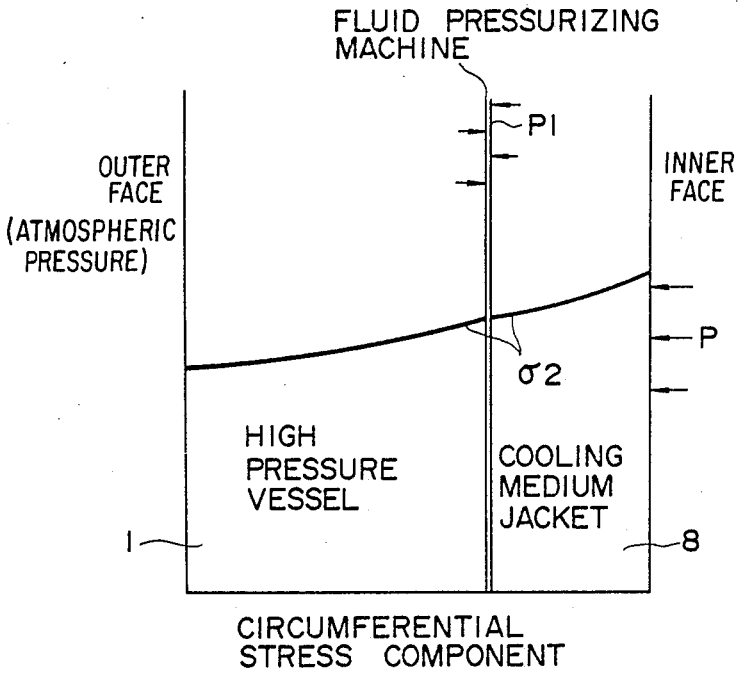
FIG. 12 is a stress distribution diagram of the high pressure vessel shown in FIG. 10.
Figure 14:
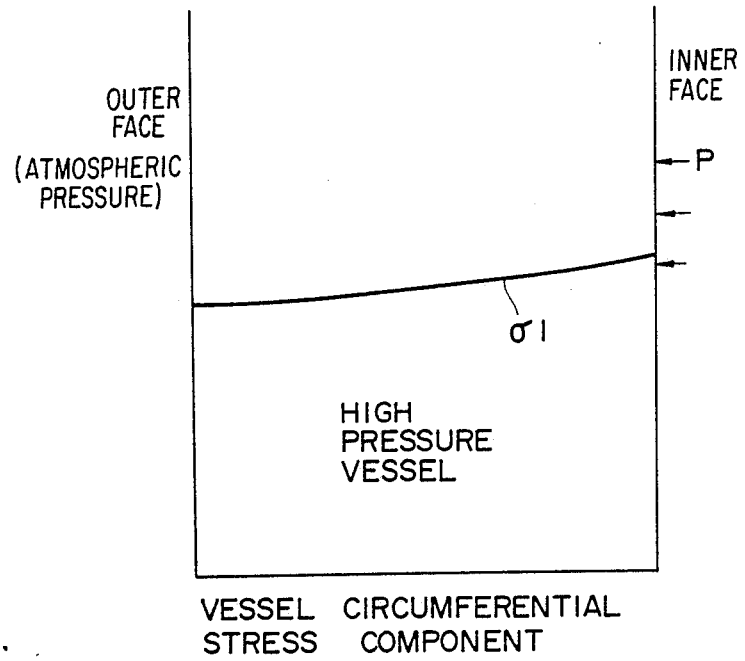
FIG. 14 is a stress distribution diagram of a common high pressure vessel.
Figure 15:
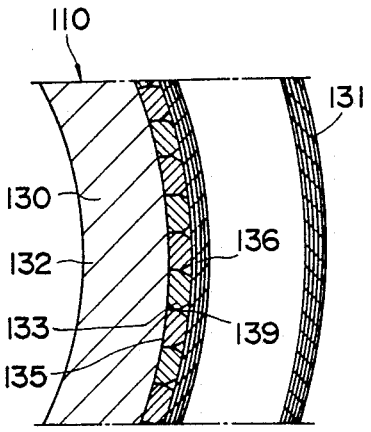
FIG. 15 PRIOR ART
FIGS. 15 and 16 are partial sectional views showing conventional cooling devices for a high pressure vessel.
Figure 16:
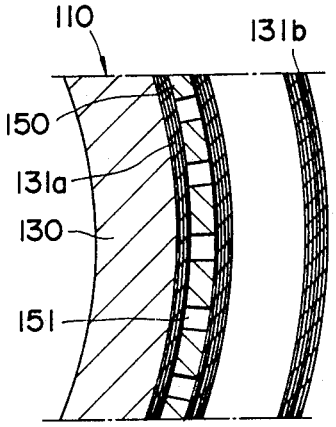
FIG. 16 PRIOR ART

In particular, as shown in FIG. 14, a maximum stress acts upon the inner face of the high pressure vessel by an internal pressure P during the HIP process, and the stress distribution on the outer face (atmospheric pressure side) makes a circumferential stress distribution curve $\sigma 1$. To the contrary, with the cooling device of the fifth embodiment, since a hydraulic pressure P1 equal to the internal pressure P acts in the gap 13, the stress distribution makes such a circumferential stress distribution curve $\sigma 2$ as shown in FIG. 12. Accordingly, possible plastic deformation or the like of the high pressure vessel 1 can be prevented more efficiently. Besides, since the gap 13 is positioned diametrically outwardly of the cooling medium jacket 9, the area of the outer surface of the cooling medium jacket 9 is greater than the area of the inner surface of the cooling medium jacket 9, and accordingly, even if a hydraulic pressure to be supplied into the gap 13 is lower than a pressure of gas for the HIP process, it can sufficiently assure a pressure balance between the outside and the inside of the cooling medium jacket 9.

Figure 13:
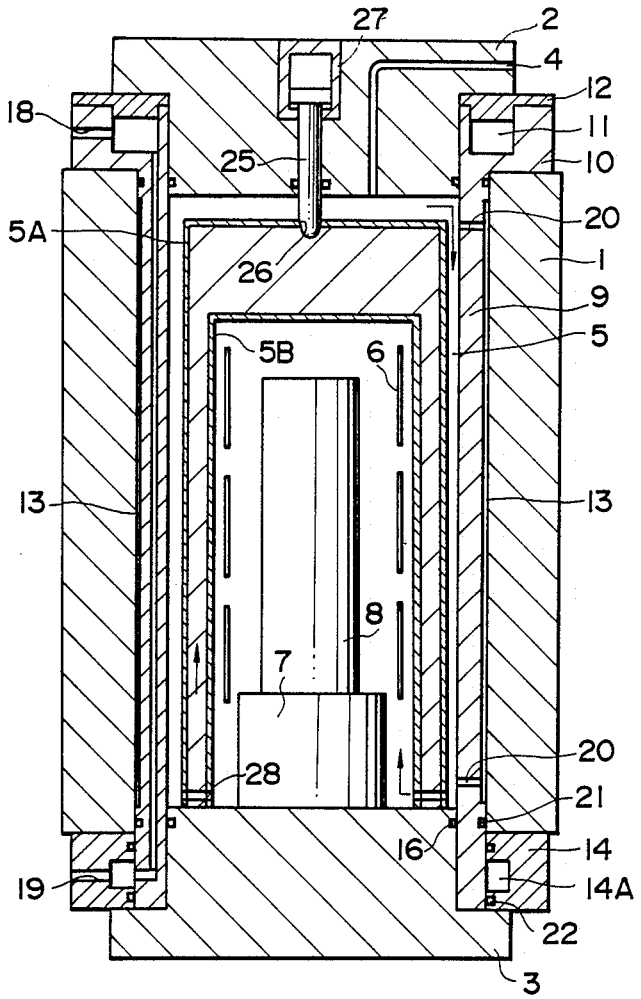
FIG. 13 is a vertical sectional front elevational view similar to FIG. 1 but showing a sixth preferred embodiment of the present invention.

FIG. 13 shows a sixth embodiment of the present invention which is an improvement of the cooling device of the first embodiment described hereinabove in that the time required for cooling after the HIP process is further reduced.

In particular, the hollow insulation mantle 5 includes at least two inverted U- or cup-shaped outer and inner casings 5A and 5B which are constructed such that gas may communicated between them. The inner casing 5B of the insulation mantle 5 is made of a metal and has an airtight structure while the outer casing 5A of the insulation mantle 5 also has an airtight structure. A path 26 having an openable and closable valve 25 is provided on an upper face of the outer casing 5A of the insulation mantle 5 while a driving unit 27 for the valve 25 is provided on the top closure 2. A gas path 28 is formed at a lower portion of the insulation mantle 5 including lower end portions of the inner and outer casings 5B and 5A of the insulation mantle 5. Thus, a gas convection route can be established such that, when the valve 25 is open, gas is introduced at the gas path 28 at the lower portion of the insulation mantle 5 into the inside of the hollow insulation mantle 5 and then exits the insulation mantle 5 by way of the valve opening path 26 at the upper portion of the insulation mantle 5, whereafter it comes returns to the gas path 28 at the lower location again.

Subsequently, operation of the cooling devices of the embodiments described above will be described.

A work piece 8 loaded in the furnace body is HIP processed, after completion of several steps such as an evacuation step and a gas displacement step, by pressurization of gas pressure medium from the pressure supply means 4, energization of the heater 6 and so forth. During such HIP process, cooling medium is continuously supplied from the cooling medium inlet passage 18 into the cooling medium passages 17 in the inside of the cooling medium jacket 9 while the cooling medium is discharged continuously from the cooling medium outlet passage 19. Consequently, cooling of the high pressure vessel 1 from the inside can be attained powerfully and efficiently.

In particular, since the cooling medium jacket 9 is present in the inside of the high pressure vessel 1, the heat exchanging capacity is increased significantly comparing with a conventional cooling device wherein a vessel is cooled from the outside. Besides, when this is coupled with the insulation mantle 5, a quick cooling effect can be anticipated without a loss.

During the HIP process, since the passage holes 20 for pressure medium extend radially through the cooling medium jacket 9, a pressure of the HIP pressure medium is applied to the gap 13 between the cooling medium jacket 9 and the high pressure vessel 1, and a force acting in a radial direction of the high pressure vessel 1 is received by the high pressure vessel 1. Consequently, the same pressures are applied to the inside and the outside of the cooling medium jacket 9, and accordingly, a problem of pressure balance can be solved readily.

Meanwhile, an axial tension during the HIP process is carried by the press frame held in engagement with the top and bottom closures 2 and 3, and the upper and lower seal rings 15 and 16 for the top closure 2 and the bottom closure 3 contact with the cooling medium jacket 9. Thus, since the axial load applied to the axial tension receiving press frame (not shown) for supporting the top and bottom closures thereon is determined as cooling medium jacket opening area $\times$ pressure, there is an added advantage that, even if the inner diameter of the high pressure vessel 1 is increased more or less, the allowable load of the axial tension receiving press frame need not be increased.

Further, with the cooling device of the fifth embodiment of the present invention, the pressure acting on the cooling medium jacket 9 during the HIP process can be maintained by a hydraulic pressure of fluid introduced into the gap 13, and the hydraulic pressure holding force of the fluid in the gap 13 can be controlled freely in accordance with the pressure for the HIP process.

Further, after the predetermined HIP process is completed, a cooling step is entered. The cooling step proceeds in the following manner.

In particular, the valve 25 at the upper location shown in FIG. 13 is moved upwardly so that the upper path 26 of the outer casing 5A of the insulation mantle 5 is opened. It is to be noted that this is normally performed automatically in accordance with an automatically set sequencing operation.

After the valve 25 is moved upwardly to open the path 26, the inside of the furnace body is heated, and high temperature gas moves upwardly by connection within the insulation mantle 5, passes through the upper path 26 and flows out of the insulation mantle 5. Then, since cooling medium is communicated in the cooling medium passages 17 in the cooling medium jacket 9, the cooling medium jacket 9 provides heat exchange. Consequently, the high temperature gas is cooled and increased in weight so that it moves downwardly and flows into the inside of the insulation mantle 5 by way of the gas path 28 at the lower location, thereby forming a long gas convection route. Accordingly, the gas takes heat efficiently from a product after completion of the HIP process and promotes a cooling effect.

It is to be noted that a safety device is provided such that, if in this instance the temperature of the inner face of the high pressure vessel 1 reaches a predetermined valve, for example, to 150° C., value 25 moves down automatically to close the upper path 26.

When confirmation of a condition of the inner face of the high pressure valve 1 is to be made, gas pressure medium for the HIP process and cooling medium for the cooling medium jacket 9 are discharged and collected, and in the case of the cooling device shown in FIG. 10, also the hydraulic fluid for supporting the the cooling medium jacket 9 is discharged and collected, whereafter the top and bottom closures 2 and 3 are pulled off in the axial direction of the vessel 11 and also the cooling medium jacket 9 is pulled off in the axial direction of the vessel 11. After that inspection, confirmation and so forth of the entire inner face of the high pressure vessel 1 can be made readily.

While the foregoing description relates to the construction and operation of the cooling device of the embodiments of present invention shown in the drawings, the present invention can be embodied also in the following manner.

First, a cooling device can be constructed by a suitable combination of the cooling device of the individual embodiments shown.

Subsequently, either one of the top and bottom closures may be formed in an integral relationship with the high pressure vessel while loading and unloading of the furnace body, a work piece and the cooling medium jacket can be carried out via the other openably and closably mounted closure.

Further, cooling fins may be provided on either one or both of the inner and outer peripheral faces of the cooling medium jacket only if they do not interfere with loading or unloading of the cooling medium jacket.

Having now fully described the invention, it will be apparent to one of ordinary skill in the art that many changes and modifications can be made thereto without departing from the spirit and scope of the invention as set forth herein.

What is claimed is:

1. A device for cooling a high temperature, high pressure vessel of a hot isostatic pressurizing equipment which includes a high pressure vessel having at the axial opposite ends thereof a pair of openings which are each closed by removable closure members to define a high pressure chamber in the inside of said high pressure vessel, a heater disposed in said high pressure chamber, an insulation mantle surrounding said heater in said high pressure chamber, and a pressure medium supply means for supplying pressure medium into said high pressure chamber, said device comprising a substantially circumferentially continuous cylindrical cooling medium jacket having at least one passage for cooling medium formed therein, said cooling medium jacket being removably disposed in an axial direction of said high pressure vessel in said high pressure chamber between an inner face of said high pressure vessel and an outer face of said insulation mantle such that a gap is left between the inner face of said high pressure vessel and an outer face of said cooling medium jacket, said cooling medium jacket having passage holes for pressure medium formed therein for establishing communication between said gap and said high pressure chamber to allow pressure medium to be introduced into said gap.

2. A device for cooling a high temperature, high pressure vessel according to claim 1, wherein said cooling medium jacket is composed of an inner tube and an outer tube, and said at least one cooling medium passage extends along an interface between said inner and outer tubes of said cooling medium jacket.

3. A device for cooling a high temperature, high pressure vessel according to claim 1, wherein said passage holes extend in a radial direction in said cooling medium jacket.

4. A device for cooling a high temperature, high pressure vessel according to claim 1, wherein said passage holes are formed in a radial direction at each of two opposite axial portions of said cooling medium jacket.

5. A device for cooling a high temperature, high pressure vessel according to any one of claims 1 to 4, including a flange formed at an upper end portion of said cooling medium jacket, and a cooling medium tank for cooling medium formed in said flange.

6. A device for cooling a high temperature, high pressure vessel according to claim 5, including a ring mounted on a lower end face of said vessel and having a lower cooling medium tank formed therein, wherein a lower end of said cooling medium jacket is fitted in said ring.

7. A device for cooling a high temperature, high pressure vessel according to claim 6, wherein a plurality of cooling medium passages for interconnecting said upper cooling medium tank at the upper end portion of said cooling medium jacket and said lower cooling medium tank formed in said ring extend in the axial direction of said high pressure vessel and are in a circumferentially spaced relationship in said cooling medium jacket.

8. A device for cooling a high temperature, high pressure vessel according to claim 6, wherein at least one cooling medium passage for interconnecting said upper cooling medium tank at the upper end portion of said cooling medium jacket and said lower cooling medium tank formed in said ring extends in a spiral configuration in said cooling medium jacket.

9. A device for cooling at high temperature, high pressure vessel according to any one of claims 1 to 4, including a ring mounted at a lower end face of said high pressure vessel and having formed therein an cooling medium tank which has a cooling medium inlet passage and a cooling medium outlet passage, wherein a lower end of said cooling medium jacket is fitted in said ring, and said cooling medium jacket has a cooling medium passage formed therein which includes axial paths and circular paths for interconnecting said cooling medium inlet passage and said cooling medium outlet passage.

10. A device for cooling a high temperature, high pressure vessel of a hot isostatic pressurizing equipment which includes a high pressure vessel having at the axial opposite ends thereof a pair of openings which are each closed by a removable closure members to define a high pressure chamber in the inside of said high pressure vessel, a heater disposed in said high pressure chamber, an insulation mantle surrounding said heater in said high pressure chamber, and a pressure medium supply means for supplying pressure medium into said high pressure chamber, said device comprising a substantially circumferentially continuous cylindrical cooling medium jacket having at least one, passage for cooling medium formed therein, said cooling medium jacket being removably disposed in an axial direction of said high pressure vessel in said high pressure chamber between an inner face of said high pressure vessel and an outer face of said insulation mantle such that a gap is left between the inner face of said high pressure vessel and an outer face of said cooling medium jacket. and another pressure medium supply means provided in said gap for introducing therethrough a hydraulic pressure medium different from the pressure medium for the hot isostatic pressurizing process to support said cooling medium jacket with a hydraulic a hydraulic pressure of the different pressure medium.

11. A device for cooling a high temperature, high pressure vessel according to claim 10, wherein said cooling medium jacket is composed of an inner tube and an outer tube, and said at least one, cooling medium passage extends along an interface between said inner and outer tubes of said cooling medium jacket.

12. A device for cooling a high temperature, high pressure vessel according to claim 10 or 11, including a flange formed at an upper end portion of said cooling medium jacket, and a cooling medium tank for cooling medium formed in said flange.

13. A device for cooling a high temperature, high pressure vessel according to claim 12, including a ring mounted on a lower end face of said vessel and having a lower cooling medium tank formed therein, wherein a lower end of said cooling medium jacket is fitted in said ring.

14. A device for cooling a high temperature, high pressure vessel according to claim 13, wherein a plurality of cooling medium passages for interconnecting said upper cooling medium tank at the upper end portion of said cooling medium jacket and said lower cooling medium tank formed in said ring extends in the axial direction of said high pressure vessel in a circumferentially spaced relationship in said cooling medium jacket.

15. A device for cooling a high temperature, high pressure vessel according to claim 13, wherein a cooling medium passage for interconnecting said upper cooling medium tank at the upper end portion of said cooling medium jacket and said lower cooling medium tank formed in said ring extends in a spiral configuration in said cooling medium jacket.

16. A device for cooling at high temperature, high pressure vessel according to claim 10 or 11, including a ring mounted at a lower end face of said high pressure vessel and having formed therein an cooling medium tank which has a cooling medium inlet passage and a cooling medium outlet passage, wherein a lower end of said cooling medium jacket is fitted in said ring, and said cooling medium jacket has a cooling medium passage formed therein which includes axial paths and circular paths for interconnecting said cooling medium inlet passage and said cooling medium outlet passage.

* * * * *